US008618493B2

(12) United States Patent
Mindermann et al.

(10) Patent No.: US 8,618,493 B2
(45) Date of Patent: Dec. 31, 2013

(54) APPARATUS AND METHOD FOR DETECTING THE PRESENCE OF A FLAME

(75) Inventors: Kurt-Henry Mindermann, Ratingen (DE); Jens Michael Mindermann, Ratingen (DE)

(73) Assignee: BFI Automation Dipl-Ing. Kurt-Henry Mindermann GmbH, Ratingen (DE)

( * ) Notice: Subject to any disclaimer, the term of this patent is extended or adjusted under 35 U.S.C. 154(b) by 267 days.

(21) Appl. No.: 13/317,002

(22) Filed: Oct. 6, 2011

(65) Prior Publication Data

US 2012/0138809 A1 Jun. 7, 2012

(30) Foreign Application Priority Data

Oct. 8, 2010 (EP) ..... 10013450

(51) Int. Cl.
*G01N 21/33* (2006.01)

(52) U.S. Cl.
USPC ..... 250/372

(58) Field of Classification Search
USPC ..... 250/372
See application file for complete search history.

(56) References Cited

U.S. PATENT DOCUMENTS 4,279,254 A * 7/1981 Boschetti et al. ..... 607/94
2002/0081545 A1* 6/2002 Mindermann et al. ..... 431/18

FOREIGN PATENT DOCUMENTS

GB 2206204 A * 12/1988

* cited by examiner

*Primary Examiner* — Casey Bryant
(74) *Attorney, Agent, or Firm* — Aliz, Yale & Ristas, LLP

(57) ABSTRACT

Apparatus for detecting the presence of a flame using a UV tube which can be supplied with a DC voltage via an operating resistor, at least two UV tubes which are arranged in this manner and have substantially the same field of vision being provided, and the two UV tubes being able to be switched on and off in succession with a gap of a predefined time within a predetermined interval of time via a controller, with the result that the UV tubes are switched on for a predeterminable period of time, the number of pulses obtained from each UV tube being able to be recorded and compared with one another, the anode of the respective UV tube being able to be connected to earth potential between the operations of switching the UV tubes off and on in order to draw ionization in the discharge area.

20 Claims, 6 Drawing Sheets

APPARATUS AND METHOD FOR DETECTING THE PRESENCE OF A FLAME

BACKGROUND

The invention relates to an apparatus for detecting the presence of a flame and to a method for detecting the presence of a flame.

Apparatuses for detecting the presence of a flame are used as flame monitors when monitoring combustion plants and are used as flame detectors in the field of fire prevention.

The aim of any combustion plant operator is to improve the overall efficiency of his furnace, to reduce pollutant emission and to safely monitor the combustion process with safety-related progress and optimum availability.

Radiation detectors are provided for safe monitoring, which detectors convert radiation into a measurable electrical variable according to a fixed relationship. If a definable threshold value for the measured variable is undershot, a "flame off" signal can be generated, after which the fuel supply can be switched off for safety reasons.

In the case of the radiation detectors, a distinction is made between photoelectric detectors and thermal detectors which have different radiation sensitivities and—according to the set task—are used with respect to the parameters to be recorded.

The photoelectric detectors respond to the energy quanta of radiation and their spectral sensitivity depends on the wavelength.

For reasons of price in particular, UV tubes are still used as flame sensors or flame monitors for flame monitoring, but the problem of so-called "flashovers" being able to occur in these components exists in principle. A glow discharge which cannot be distinguished from a normal flame signal by the electronics connected to the UV tube can occur without external UV irradiation.

A plurality of solutions relating to how flashovers can be detected and processed in a safety-oriented manner are known.

For example, DE 1 256 828 A discloses the practice of only periodically applying the UV radiation coming from a flame to the photocell by only periodically exposing a UV-sensitive element to the radiation by means of a rotating perforated disc. A flashover in the UV-sensitive element can be detected with a monitoring circuit, which has capacitors and transistors, in conjunction with the rotating perforated disc.

In principle, in order to detect a flashover, the incident radiation is thus periodically interrupted by a shutter mechanism. If further discharges occur in the tube in this dark phase, this is detected by the electronics connected to the UV tube, that is to say a flame relay is switched off.

A mechanical shutter mechanism which periodically interrupts the incident radiation has a limited service life on account of wear. If the times between two successive closing operations of the mechanical shutter are extended, the circuitry outlay needed to determine flashovers between the two closing operations of the shutter becomes lower; the detector element should be new and safe.

If the time between two successive closing operations of the shutter mechanism is reduced, safety is indeed increased with respect to the detection of a flashover, but the mechanical wear on the shutter mechanism also increases. In addition, deviations from the alignment of the shutter and contamination caused by abrasion, for example, may result in failure of the flame monitoring.

DE 1 293 837 A discloses a device for monitoring a pulse generator, which has a UV tube, for faults of the UV tube, in which a threshold value circuit at the output of the pulse generator is designed such that it responds only to those pulses which occur when the UV tube operates in a faultless manner. In this case, particular signal forms and values which lead to faulty detection of flashovers or extraneous radiation can be assumed.

DE 1 955 338 B describes that it is known practice to use two UV photocells which monitor the same flame and have relay circuits consisting of at least two relays connected downstream of them. The relay circuits only have a switching state which allows fuel to be supplied when the sum of the signals—a voltage drop across a series resistor—from the UV photocells exceeds a particular value and the difference between the two voltage drops undershoots a particular value. Said document describes that detection of a flashover is not important as long as the second UV photocell operates in a faultless manner. This is disadvantageous for burners which have been operating without interruption for half a year or more, with the result that it is not possible to exclude the situation in which both UV photocells also undergo a flashover during this time. DE 1 955 338 B therefore follows the route of configuring a UV flame monitor with a single UV photocell and a downstream channel without using mechanical elements. The flashover in a UV photocell is detected by virtue of the fact that a constant gas discharge at the series resistor produces a DC voltage which is used as a signal for the fault state of the UV photocell. A different radiation is required for this purpose.

DE 26 29 321 A1 discloses a device for monitoring flames in burners in furnaces, in which an electronically controllable liquid crystal shutter is fitted upstream of the optical flame sensor, through which shutter only the optical signal from the flame reaches the flame sensor and which shutter is periodically controlled from the transparent state into the darkened state. The modulated light signal from the flame sensor is evaluated via a frequency filter for flame monitoring. DE 26 29 321 A1 thus follows the route of using a liquid crystal shutter, which does not require any (precision) mechanical components, to shade the flame sensor. In practice, this use results in high attenuation of the UV radiation and in insensitivity which no longer suffices for the desired measurement purposes.

It becomes clear from the above that a plurality of solutions have been proposed for designing a safe apparatus for detecting the presence of a flame and a method for detecting the presence of a flame, which reliably detects flashovers and a malfunction. However, the proposed solutions all have a disadvantage which results in a high degree of wear on and/or a complicated design of mechanical components or electronic circuits, in which case compromises are accepted.

SUMMARY

The object of the invention is therefore to provide an apparatus for detecting the presence of a flame and a method for detecting the presence of a flame, with which the presence of a flame is given with little outlay and a long lifetime in conjunction with continuous functional safety and availability.

At least two UV tubes are arranged in this manner and have substantially the same field of view. That is to say, the UV tubes can be used to monitor substantially the same area of the flame. The UV tubes can be supplied with a DC voltage via an operating resistor. The two UV tubes can be switched on and off in succession within a predetermined interval of time via a controller, i.e., one of the two UV tubes is respectively switched on (i.e., supplied with the DC voltage via the operating resistor), while the other is switched off. After the UV tube which was previously supplied with the DC voltage has been switched off, the other of the two UV tubes is switched on. There is no time range in which both UV tubes are switched on together at the same time. Both the operations of switching the two UV tubes on and off and a time which elapses between the operation of switching off one UV tube and the operation of switching on the other UV tube are in the predetermined interval of time. This time can be predefined via the controller. A time or a gap between the operation of switching off one UV tube and the operation of switching on the other UV tube can thus be predetermined via the controller. The UV tubes are switched on for a predeterminable period of time. When UV radiation impinges, ignition occurs in the UV tube and a current flows, via the operating resistor, through the tube with a voltage drop to below the arc voltage. As a result, the ignition in the UV tube must immediately stop. The operating voltage then reaches its original value again which is above the ignition voltage, in which case a new ignition process starts when UV radiation impinges. This process is repeated in quick succession, with the result that pulses are produced per period in which the UV tube is switched on, the number of said pulses depending on the intensity of the UV radiation. These pulses are recorded for each of the two UV tubes and are compared with one another.

The anode of the respective UV tube is connected to earth potential between the operations of switching the UV tubes off and on in order to draw ionization in the discharge area. The anode of the UV tube which has been switched off is connected to earth potential. If differences between the signals obtained from each UV tube are determined, they can be used for alarm messages which may be necessary or to disconnect the burner.

If flashover pulses occur in a UV-tube during possible continuous operation of the burner, these flashover pulses are added to the pulses which come from the UV radiation to be monitored. The flashovers are therefore detected and are concomitantly used for evaluation. Non-uniform aging of the UV tubes is also detected by comparing the recorded signals from the two UV tubes.

The presence of a flame is safely detected in a redundant and fully electronic manner without mechanical wear. The detection of the flame is safe since a self-test of the UV tubes is continuously effected. The self-test is independent of whether or not a flame is present. The required high level of safety with good availability is obtained as a result of further double protection in the evaluations carried out in analogue format and parallel to the digitally connected evaluation. The additional use of the number of pulses results in the use of a more reliable variable than the discharge current or the voltage which was previously recorded in the prior art since the glow ionization could also have a negative effect on the voltage or current to be measured. The flashovers which possibly occur on account of a longer operating time and storage for a longer time are safely detected.

The controller is preferably configured to determine switch-on and switch-off thresholds in a programmable manner, with the result that strong influences as a result of the aging of the tubes are also detected on the basis of glow ignitions. Ionization clouds which suddenly occur and lead to pulsed ignitions may initiate the flashovers which can be recorded. This would also be detected within a very short time.

The ongoing self-monitoring according to the invention even when a flame is not present leads to better availability, for example in the case of gas blocks which are on standby in power plants. The self-test takes place even if the gas blocks are not fired. Even before the gas block is intended to be fired, it is possible to detect that the apparatus is defective or flashovers in the UV tubes are occurring. The apparatus can then be immediately replaced. In previously known methods and apparatuses, a (pre-exposure) check is carried out only shortly before firing and can result in the burner or the gas block not being able to be activated since the apparatus first has to be replaced. Since replacement is carried out after a request to fire the gas block, the availability has hitherto been reduced. The apparatus and the method are used as a flame monitor.

In terms of fire prevention, the continuous self-test with regard to non-uniform aging of the UV tubes results in a self-diagnosis of when the apparatus has to be replaced or changed. The apparatus and the method are used as a flame detector.

The previously pursued solutions for detecting the malfunction of UV tubes when detecting the presence of a flame took a different route. Instead of the age in the proposed possible solutions, the inventor was the first to realize that the apparatus according to the invention and the method according to the invention overcome the disadvantages of the apparatuses and methods previously known from the prior art.

The required high voltage for the UV tubes is preferably generated via a Villard cascade circuit with a charge pump for the frequency, a control voltage being in the low-voltage range of one to five volts DC. The Villard cascade circuit can be operated with a supply voltage of 24 volts DC, like in the conventional and common switchgear. The selected design of the high-voltage generation by means of a cascade circuit avoids the disadvantages of the power supply unit solutions known on the market. For example, a switching transformer or a mains transformer would also be a very expensive and also more space-intensive solution.

The level of the DC voltage can preferably be preselected by the controller in order to be able to operate the UV tube with a predetermined sensitivity setting and in order to be able to subject it to a self-test. The DC voltage which can be applied to the respective UV tube and is intended to operate the UV tube can therefore be automatically changed to a predetermined value in a very simple manner at a preselectable time; for example, an increase by approximately 15% according to EN standard 298 or TUV regulations from 236 volts to 271 volts, for example, may be provided. The overall sensitivity and number of pulses in the case of UV irradiation are also highly dependent on the DC voltage. The number of pulses increases greatly with the increase in the DC voltage. An increase of approximately 10% in the DC voltage results in an increase in the relative sensitivity by approximately 50%. The sensitivities thus generally change by approximately 100% given an increase in the DC voltage of approximately −10% to approximately +10%. If the expected or precalculable number of pulses is not determined when increasing the operating voltage, the UV tube is defective. When the operating voltage of the UV tube changes, the controller thus carries out a self-test. The greater the selected increase in the operating voltage, the more sensitive the setting in terms of a self-test of the UV tube.

The DC voltage for each UV tube is preferably increased periodically, in which case the DC voltage is not increased at the same time in the two UV tubes during operation of the UV tube, in particular if the two UV tubes are switched on in succession.

The UV tubes can preferably be oriented to the flame via a rotatable latchable unit. As a result, the tubes can be oriented in a very accurately rotatable and lockable manner on a housing. In this case, it is possible for the UV radiation to axially or radially irradiate the unit containing the UV tubes. If the unit is radially irradiated, a short longitudinal extent in the direction perpendicular to the flame being monitored or a flame which suddenly occurs is possible.

The UV tubes can preferably be fastened in the housing or the unit via plug-in connections with secure locking in the unit, with the result that the tubes in the block can be easily replaced in the event of servicing. Replacement can be effected by replacing a complete unit or a section which can be detached from the unit, which simplifies maintenance and/or repair.

The controller is preferably in the form of an SMD, that is to say a surface-mounted device or flat component. The permissible ambient temperature can be increased to a maximum of 120° C. depending on the data relating to the selected UV tubes.

The interval of time is preferably in the region of one second and the time for which the UV tubes are each switched on is in the region of several hundred milliseconds. The time for which the UV tubes are each connected to earth potential is in the region of several milliseconds, with the result that a fault is immediately detected within one second. Safe monitoring is thus ensured. Timely disconnection or a fault message, in particular also during continuous operation and long unsupervised operation of the burners for more than 72 hours, is thus ensured as well as standby at a standstill.

BRIEF DESCRIPTION OF THE DRAWING

The invention is disclosed in more detail below using the exemplary embodiments which are illustrated in the accompanying figures, in which.

DETAILED DESCRIPTION

Figure 1:
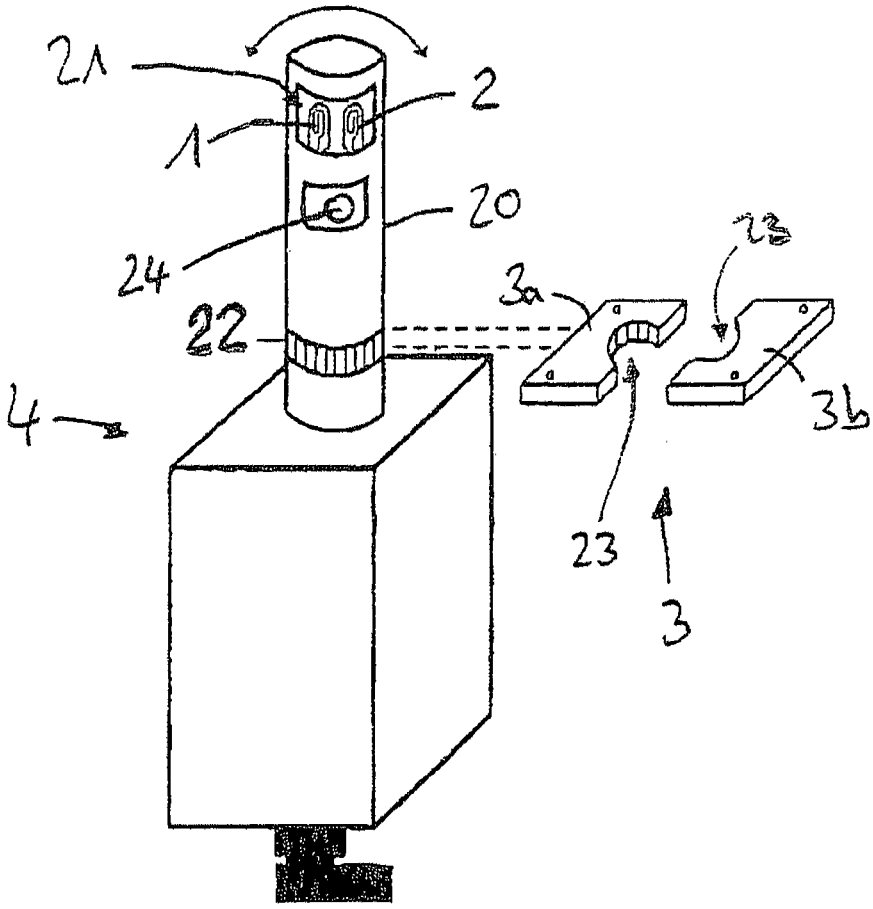
FIG. 1 diagrammatically shows UV tubes of an apparatus according to the invention.

FIG. 1 shows UV tubes 1, 2 of an apparatus according to an embodiment of the invention. The apparatus has at least the two UV tubes 1, 2 which can be supplied with a DC voltage via an operating resistor. The two UV tubes 1, 2 have substantially the same field of vision, with the result that they record the same area of a flame. The two UV tubes 1, 2 are arranged close to one another and can be exposed in the direction of a flame to be monitored or a flame which possibly occurs.

A unit 4 on which the two UV tubes 1, 2 are arranged or fastened is provided. The two UV tubes 1, 2 are releasably fastened in a cylindrical section 20 of the unit 4 by means of plug-in connections with secure locking. The cylindrical section 20 of the unit 4 has a radially oriented window 21 which exposes the front area of the UV tubes 1, 2 to the flame, with the result that the two UV tubes 1, 2 can be oriented, in particular, to the flame root of the flame to be monitored or a flame which possibly occurs. The unit 4 is securely held in a mounting holder 3. For rotatable locking in order to orient the UV tubes 1, 2 to the flame, the cylindrical section 20 of the unit 4 has external toothing 22. The mounting holder 3 has a recess into which the cylindrical section 20 can be inserted and which in turn has toothing 23 which corresponds or is complementary to the external toothing 22.

In FIG. 1, the mounting holder 3 is illustrated as a receptacle for the unit 4, which receptacle is configured from two mounting holder sections 3*a*, 3*b*. The two mounting holder sections 3*a*, 3*b* accommodate the cylindrical unit 20 with its external toothing 22 in the recess with the toothing 23. The mounting holder 3 is pivotably fastened, with the result that the UV tubes 1, 2 arranged in the cylindrical section 20 of the unit 4 can be oriented to the flame to be monitored or a flame which possibly occurs.

The unit 4 is engaged in the mounting holder 3 with an adjustment. With optimum orientation, the two UV tubes 1, 2 are oriented to the flame root since the proportion of UV is highest there. In the optimized case, the UV tubes 1, 2 each detect half the flame root, that is to say one of the two UV tubes 1, 2 detects the "right-hand" area of the flame root and the other of the two UV tubes 1, 2 detects the "left-hand" area of the flame root. With optimum orientation and with identical behaviour of the two UV tubes 1, 2, an identical number of pulses for the same unit of time is measured when a flame is present. As a result of a DC voltage for operating the UV tubes 1, 2 which is possibly set differently, different recorded numbers of pulses of the two UV tubes 1, 2 can be compensated for with an adjustment.

Figure 2:
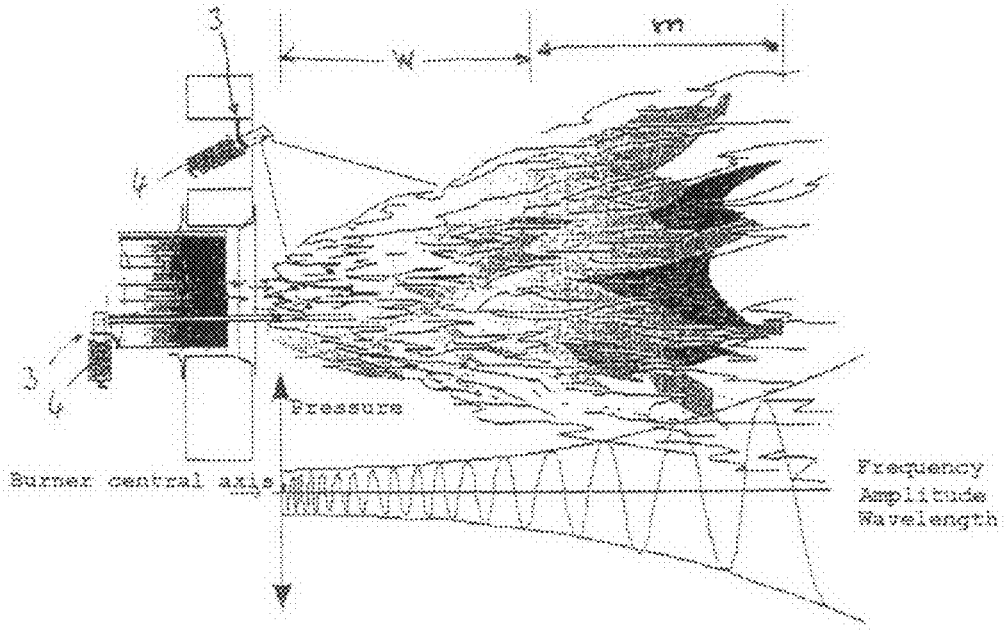
FIG. 2 diagrammatically shows the UV tubes shown in FIG. 1 installed in a combustion chamber of a burner.

FIG. 2 illustrates the apparatus as shown in FIG. 1, in a manner arranged upstream of a combustion chamber of a burner as a flame monitor. Two flame monitors which are oriented to the flame root (that area of the flame which is denoted w) are provided in FIG. 2. The units 4 are engaged in the mounting holders 3. That area of the flame which is denoted m is the combustion zone. The pressure is indicated under the flame based on the burner central axis which represents the x axis. When assessing a flame, the frequency, the amplitude and the wavelength can be evaluated. In order to assess a flame, it is possible to provide a sensor 24 (cf. FIG. 1), as is disclosed in EP 2105669 A1 for example.

A controller which may be in the form of an SMD is provided for the purpose of driving and operating the UV tubes 1, 2. The controller for operating the UV tubes 1, 2 may also drive the sensor 24 and evaluate the recorded signals.

Figure 3:
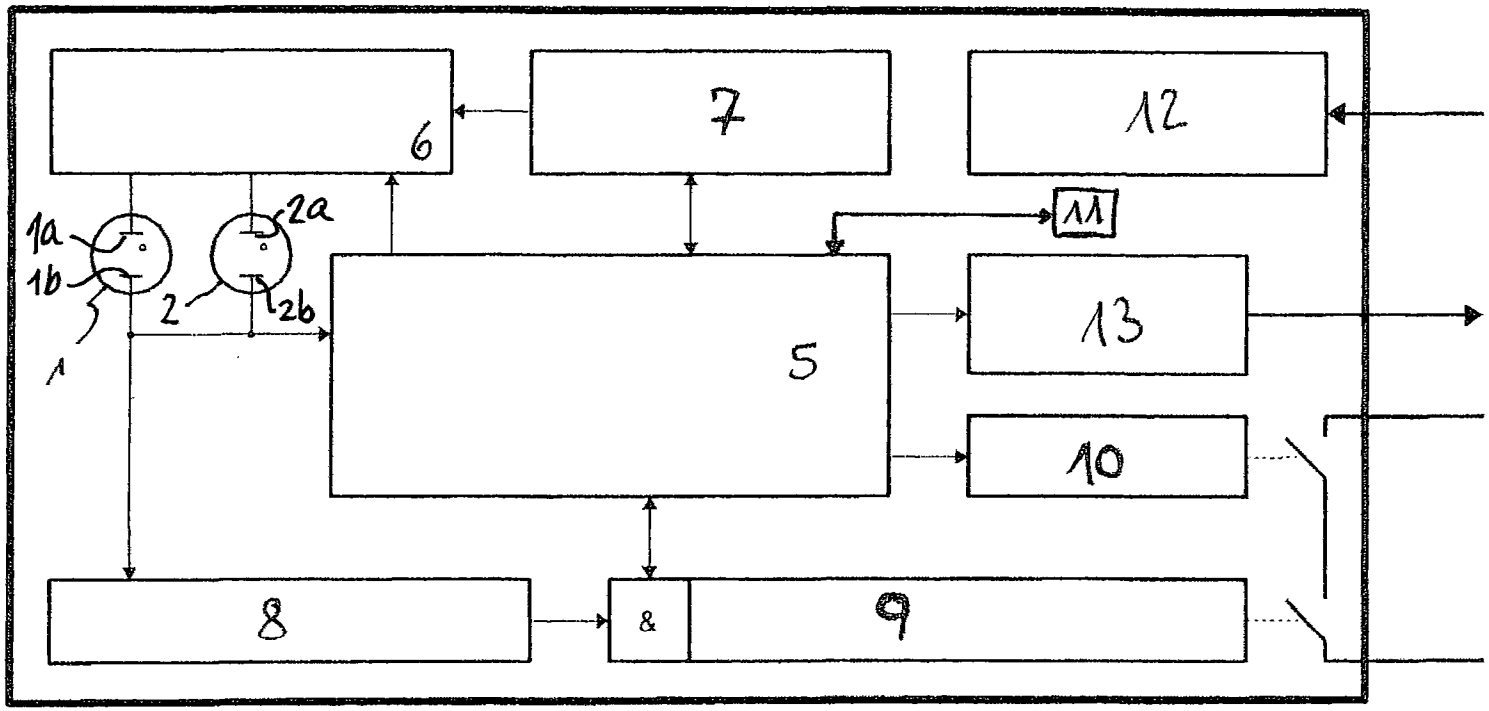
FIG. 3 diagrammatically shows a block diagram of an apparatus according to the invention.

FIG. 3 diagrammatically shows the controller with further elements. The controller has a microcontroller or a microprocessor 5 which is connected to the UV tubes 1, 2 via a high-voltage changeover and tube discharge unit 6. The tubes have respective cathodes 1*a*, 1*b* and anodes 2*a*, 2*b*. The controller also uses the microprocessor 5 to control a cascade circuit 7 which is in the form of a Villard cascade circuit. The cascade circuit 7 and the high-voltage changeover and tube discharge unit 6 may be part of the controller. The cascade circuit 7 may supply the high-voltage changeover and tube discharge unit 6 with voltage. The microprocessor 5 and the cascade circuit 7 are connected in a bidirectional manner. This makes it possible to control the high voltage.

The diagrammatically shown cascade circuit 7 in the form of a Villard cascade circuit has a charge pump which sets the high voltage via a frequency, the control voltage being in the low-voltage range. The cascade circuit can be operated with a DC voltage, in particular 24 volts DC.

The DC voltage generated by the cascade circuit 7 can be supplied to the UV tubes 1, 2 via the high-voltage changeover and tube discharge unit 6 in order to operate the UV tubes 1, 2. The DC voltage used to operate the UV tubes 1, 2 can be preselected by the controller using the microprocessor 5. The operating voltage of the UV tubes 1, 2 can therefore be selected via the controller. Exemplary DC voltages for operating the UV tubes 1, 2 are 325 volts, 345 volts, 365 volts and 385 volts.

The signal at the UV tubes 1, 2 in the form of pulses on account of a detected flame which is present is supplied both to the microprocessor 5 of the controller and to a safety-oriented monitor channel 8. The output of the monitor channel 8 is connected to an input of a safety-oriented relay drive 9 which is also coupled to the microprocessor 5 of the controller in a bidirectional manner. This also makes it possible to monitor the relay stage or relay drive 9.

The monitor channel 8 checks the presence of a gap in the pulsing UV tube signal. The gap which occurs periodically is produced when changing over the UV tube voltage between the UV tubes 1, 2 and is checked for compliance with its characteristic values. The characteristic values are the minimum and maximum widths of the gap and its minimum and maximum spacings. It is thus ensured in the safety-oriented monitor channel 8 that every component failure which can be described is detected in the UV tube circuit. The monitor channel 8 itself is constructed in a safety-oriented manner in such a way that every component failure in the monitor channel 8 results in safe disconnection. In addition, the temporal behaviour of the signal generated in the monitor channel 8 is checked for plausibility by the microprocessor 5.

Figure 4:
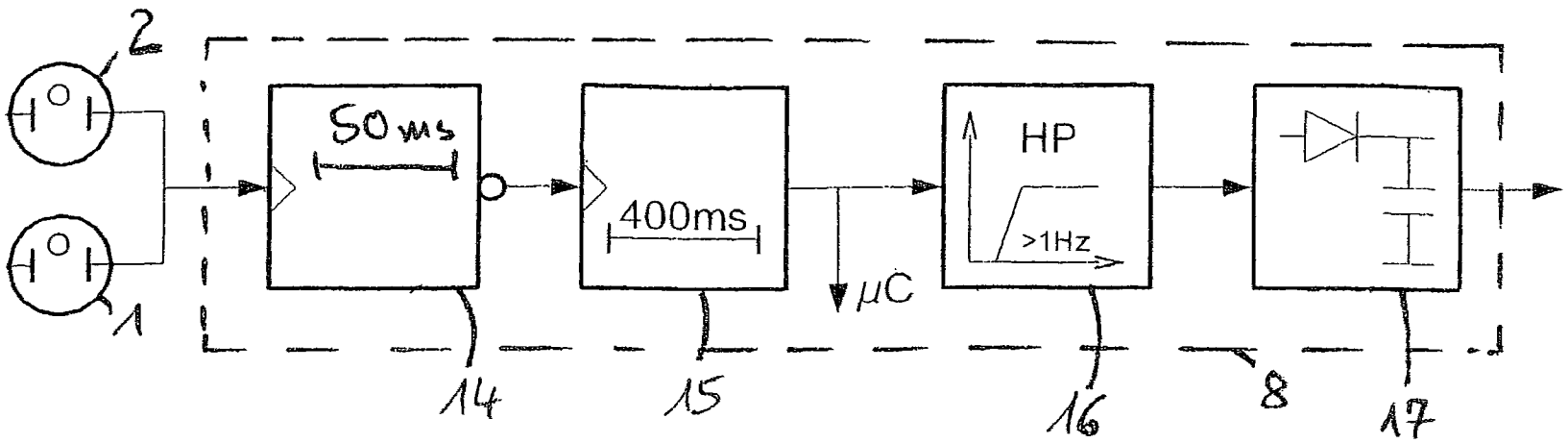
FIG. 4 diagrammatically shows a block diagram of a monitor channel of the apparatus shown in FIG. 3.

FIG. 4 illustrates a block diagram of the monitor channel 8 with the two UV tubes 1, 2. Two re-triggerable mono-stable flip-flops 14, 15 are provided. The first flip-flop 14 detects the actual signal gap in the flame signal, which is assumed to be at least 50 ms. The second flip-flop 15 detects the minimum period of the occurrence of the signal gap in the signal, which is assumed to be approximately 800 ms. A downstream high-pass filter 16 filters out gaps which occur more rarely and gaps which occur more often, for instance if the flame is too weak or if the tube is defective when a flame is absent. A rectifier 17 connected downstream of the high-pass filter 16 finally generates a sawtooth-waveform analogue signal which is checked for compliance with a voltage window by the subsequent safety-oriented relay stage 9.

The monitor channel 8 operates only with dynamic signals with particular timing, with the result that occurrence of a static signal inevitably leads to (safety-oriented) disconnection. The temporal behaviour of the monitor channel 8 can be such that, in this case too, flame extinction leads to disconnection within one second.

The microprocessor 5 of the controller assesses the signals recorded by the UV tubes 1, 2 for the purpose of flame monitoring which makes it possible to test the UV tubes 1, 2 when it is safely detected that a flame is not present. If, as described below, a weak flame or flame extinction is detected, the supply of fuel is interrupted via the safety-oriented relay drive 9. In addition to the safety-oriented channel, it is also possible for an assessment relay 10 to be driven by the microprocessor 5 of the controller.

Contactless and wireless long-distance data transmission to the controller is possible in a bidirectional manner via the LED(s) 11, which can be driven by the microprocessor 5, or the LED arrangement 11. Data and signals from the microprocessor 5 can be read out for maintenance purposes and/or in the event of a fault and can be preselected via a data bus.

In addition, a current driver 12 for small currents in the range of 4 to 20 milliamperes is provided and can be driven by the microprocessor 5; the current driver 12 can provide a signal which is representative of the qualitative flame assessment and is in the form of a current. The circuit according to FIG. 2 is operated with the voltage or current from the power supply unit 13.

Figure 5:
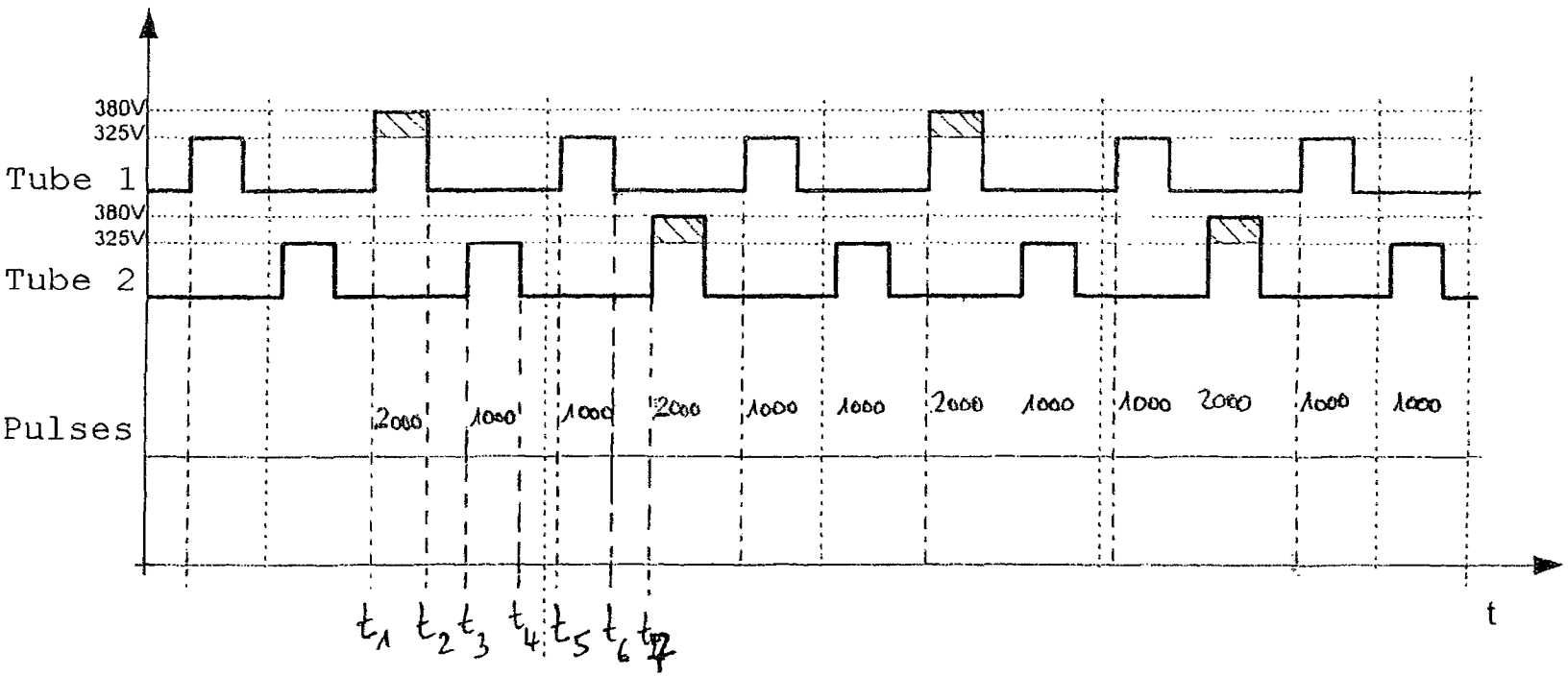
FIG. 5 diagrammatically shows evaluation of signals determined by the apparatus according to the invention, which is used as a flame monitor, when the UV tubes operate correctly, both when a flame is present and when a flame is not present.

FIG. 5 shows the procedure of switching the two UV tubes 1, 2 on and off according to the invention with the recording of pulses at the UV tubes 1, 2 when a flame is present and the UV tubes 1, 2 are operating correctly. The time t is plotted on the x axis.

The uppermost curve in FIG. 5 indicates the voltage applied to the UV tube 1. The middle curve indicates the voltage applied to the UV tube 2. In the exemplary embodiment illustrated, the voltage applied to the UV tubes 1, 2 varies between the voltage levels of 0 volts, 325 volts and 380 volts. The controller switches the two UV tubes 1, 2 on and off in succession with a gap of a predefined time. The two UV tubes 1, 2 are switched on and off in succession within a predetermined interval of time, the two UV tubes 1, 2 being switched on for a predeterminable period of time. The values of the predetermined interval of time and of the predetermined period of time and of the gap are stored in the variable memory of the microprocessor 5. When the UV tubes 1, 2 are driven periodically or operated periodically, provision may also be made for the period of time for each UV tube 1, 2 to be stored in the memory of the microprocessor 5, just like the gap between the directly successive operation of switching on the same UV tube 1, 2. The subsequent comparison and the self-test of the UV tubes 1, 2 as well as the consistency check with respect to one another are simplified if the operating time for the two UV tubes 1, 2 is identical. Furthermore, the gap between the adjacent operation of switching on the same UV tube 1, 2 can likewise be selected to be the same for both UV tubes.

According to FIG. 5, the predetermined interval of time results between the indicated times $t_1$ and $t_5$. The gap between the operation of switching off the UV tube 1 and the operation of switching on the UV tube 2 is defined by the times $t_2$ and $t_3$ indicated in FIG. 5. The period of time for which the two UV tubes 1, 2 are switched on results from the times $t_2$ and $t_1$ for UV tube and $t_4$ and $t_3$ for UV tube 2 indicated in FIG. 5. Between the operations of switching the UV tubes 1, 2 off and on, the anode of the respective UV tube 1, 2 is connected to earth potential in order to draw ionization in the discharge area, that is to say the UV tube 1 is connected to earth potential between $t_2$ and $t_5$ and the UV tube 2 is connected to earth potential between $t_4$ and $t_7$.

The predetermined interval of time is preferably approximately one second, with the result that $t_5-t_1=1$ s. The gap between the operation of switching off the UV tube 1 and the operation of switching on the UV tube 2 is preferably in the region of several hundred milliseconds, in which case $t_7-t_6=t_5-t_4=t_3-t_2=200$ ms in particular; and the period of time for which the two UV tubes 1, 2 are switched on is preferably $t_4-t_3=t_2-t_1=300$ ms. The preferred values ensure that the two-UV tubes 1, 2 are periodically switched on and off, in which case the two UV tubes 1, 2 are driven with the same periodicity, which simplifies the driving operation and the comparison of the number of pulses obtained, as is described below. However, it is also possible to drive the UV tubes 1, 2 differently by first of all respectively dividing the number of pulses by the switched-on duration of the respective UV tube 1, 2 in order to compare the number of pulses.

The lower curve represents the number of pulses recorded by each of the two UV tubes 1, 2 during their operation by the microprocessor 5.

FIG. 5 illustrates the situation in which the flame is not present until the time $t_1$ and ignition is carried out only at $t_1$. Until the time $t_1$, the pulses recorded and counted at the UV tubes 1, 2 by the microprocessor 5 are zero. From the time $t_1$ on, pulses are recorded and counted at the UV tubes 1, 2 by the microprocessor during operation of the UV tubes 1, 2 on account of the flame which is present.

Since the two UV tubes 1, 2 have the same field of vision with respect to the flame, the number of counted pulses based on a unit of time and with the same operating voltage is the same or varies in a tolerance range of approximately 5%-10%. When the flame monitor is operating correctly and a flame is present, the quotient of the number of pulses and predeterminable period of time for which the UV tubes 1, 2 are switched on, that is to say $t_6-t_5$ and $t_4-t_3$ in this case, is therefore the same in each case or is the same within the tolerance for the same operating voltage. If this is not the case, it is possible to conclude that there is a fault or a defective or aged UV tube 1, 2. This is explained with reference to FIG. 6.

If the operating voltage of the UV tubes 1, 2 varies, the number of pulses which can be recorded at the UV tube 1, 2 also varies. According to FIG. 5, the two UV tubes 1, 2 are operated at two different operating voltages, namely 325 volts and 380 volts. With a higher operating voltage, more pulses are counted at the UV tubes 1, 2 by the microprocessor. If this is not the case or if the expected numbers of pulses do not result, it is possible to conclude that there is a fault or a defective or aged UV tube 1, 2. This is explained with reference to FIG. 6.

As can be gathered from FIG. 5, the increase in the operating voltage for the two UV tubes 1, 2 from 325 volts to 380 volts leads to an increase in the number of pulses from 1000 to 2000, in which case, in the exemplary embodiment considered, the difference between $t_5$ and $t_1$, that is to say the predetermined interval of time, is one second.

During the self-test of the flame monitor, which is carried out by the microprocessor 5, a self-consistency check is carried out for each of the UV tubes 1, 2. The recorded number of pulses must be higher for an increased operating voltage than for the lower operating voltage with incident UV radiation and a flame which is present. In addition, the recorded number of pulses must be in a pre-calculable range. The recorded pulses from a UV tube 1, 2 are therefore compared with one another. Furthermore, the recorded numbers of pulses for the two UV tubes 1, 2 are compared with one another. Identical UV tubes 1, 2 must provide identical numbers of pulses or numbers of pulses which are identical in a tolerance range for the same operating voltage. Furthermore, threshold values may be stored in the memory of the microprocessor 5 for the UV tubes 1, 2, which threshold values form a lower limit and an upper limit for the value of the number of pulses for the respective operating voltage of the UV tube 1, 2. These threshold values may likewise be used to test the UV tube 1, 2.

Figure 6:
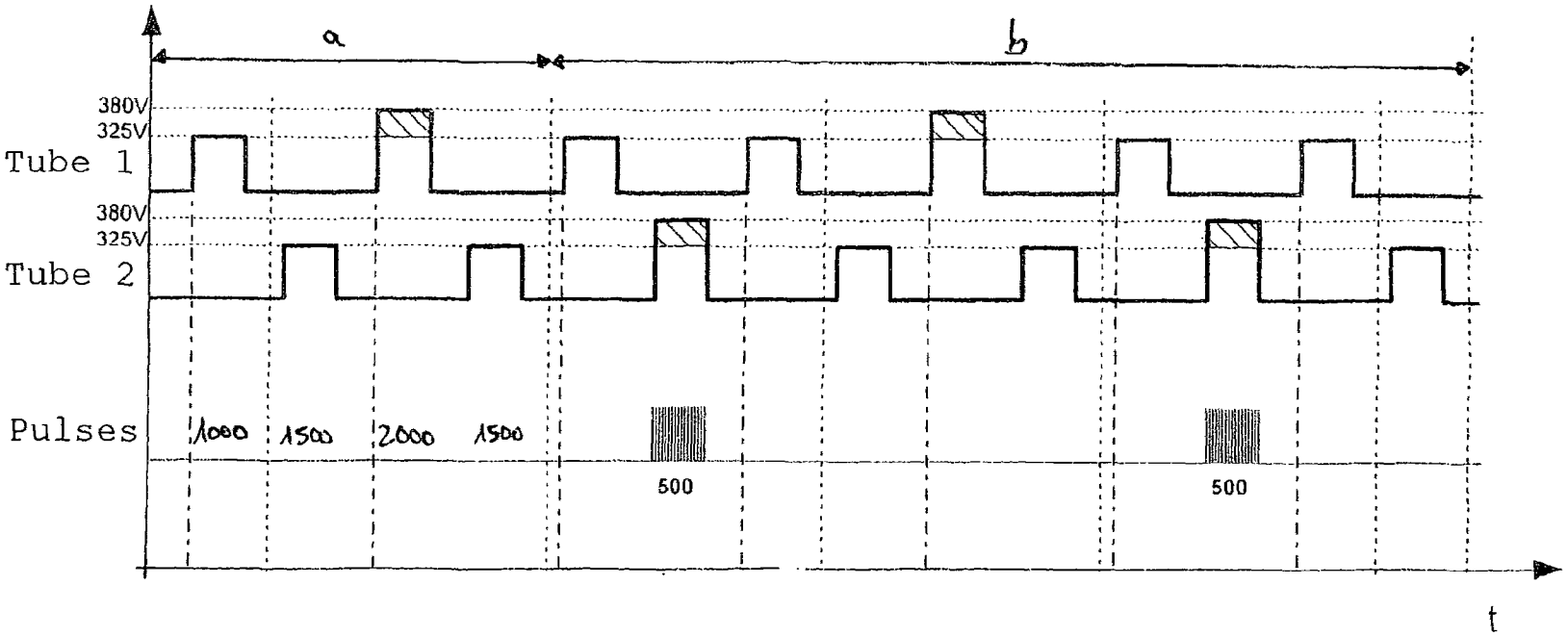
FIG. 6 diagrammatically shows evaluation of signals determined by the apparatus according to the invention, which is used as a flame monitor, in the case of a defective UV tube and when a flame is not present.

FIG. 6 shows the procedure of switching the two UV tubes 1, 2 on and off according to the invention in FIG. 5 with the recording of pulses at the UV tubes 1, 2 with a UV tube 2 which is assumed to be defective for the purpose of explanation. Two different situations are illustrated in period a and in period b in FIG. 6.

For the purpose of explanation, a flame is present in period a and no flame is present in period b.

Like in FIG. 5, the time t is plotted on the x axis. The uppermost curve indicates the voltage applied to the UV tube 1. The middle curve indicates the voltage applied to the UV tube 2. The voltage applied to the UV tubes 1, 2 varies between the voltage levels of 0 volts, 325 volts and 380 volts.

The defect in the UV tube 2 in period a is detected by comparing the number of pulses recorded for the UV tube 2 with the number of pulses recorded for the UV tube 1. The number of pulses determined by the UV tube 2 is increased in comparison with the number of pulses recorded by UV tube 1 for the same operating voltage. The UV tube 2 is identified as being defective.

Since no flame is present in period b, no pulses are counted at the UV tube 1, either at the operating voltage of 325 volts or at the operating voltage of 380 volts. In the case of the UV tube 2, no pulses are counted at the operating voltage of 325 volts but pulses are counted at the increased operating voltage of 380 volts. The behaviour of the UV tube 2 allows the conclusion to be drawn that the UV tube 2 has aged and must be replaced. So-called flashovers occur in the UV tube 2. A self-test is possible with the varying operating voltage of the same UV tube. It is thus possible to determine whether the UV tube 1, 2 is still operating correctly by comparing the pulses from the same UV tube 1, 2 at varying operating voltages. A comparison with the pulses from the second of the two UV tubes 1, 2 is also possible.

A self-test of the flame monitor also takes place when a flame is not present, that is to say during quiescent operation of the burner, since flashovers are also detected when a flame is not present since the presence of two UV tubes 1, 2 makes it possible to compare the numbers of pulses respectively determined by the two UV tubes 1, 2. If only one of the two UV tubes 1, 2 shows pulses, it is possible to infer a defect or flashovers in the UV tube 1, 2 recording the pulses. As described, flashovers are also detected when a flame is present, that is to say during working operation of the burner, on account of deviations in the number of pulses.

In addition, a further ongoing self-monitoring, as described in FIG. 6 with reference to the period of time b for example, is possible by changing the operating voltage of the UV tubes 1, 2. Although the flame is not present, the consistency of the determined signals is checked. The check for consistency concomitantly includes both the comparison of the signals from the same UV tube 1, 2 for the same operating voltage or a changed operating voltage and the comparison of the signals from the two UV tubes 1, 2 with one another.

So-called flashovers which hitherto could not be detected as such are safely detected and it is possible to reliably state whether or not a flame is present.

The invention claimed is:

1. A flame monitor for detecting the presence of a flame, comprising:

at least two UV tubes which have substantially the same field of vision, each UV tube having an anode and cathode;

a controller that supplies a DC voltage to the UV tubes whereby ionization ignition pulses in each UV tube are detectable in a discharge area of each UV tube; said controller containing circuitry for switching the two UV tubes on and off in succession with a gap of a predefined time within a predetermined interval of time, whereby the UV tubes are switched on for a predeterminable period of time and wherein the anode of each UV tube is connected to earth potential between the operations of switching the UV tubes off and on in order to draw ionization in the discharge area; and means for recording and comparing the number of pulses obtained from each UV tube.

2. The flame monitor according to claim 1, wherein the predeterminable period of time is the same for each of the two UV tubes.

3. The flame monitor according to claim 2, wherein the DC voltage for operating the UV tubes is increased for predeterminable periods of time in order to increase the sensitivity of a self-test of the respective UV tube.

4. The flame monitor according to claim 2, wherein the level of the DC voltage for operating the UV tubes can be preselected by the controller for a self-test of the UV tube.

5. The flame monitor according to claim 2, wherein the DC voltage for operating the UV tubes is increased for predeterminable periods of time in order to increase the sensitivity of a self-test of the respective UV tube.

6. The flame monitor according to claim 5, wherein a period of time with an increased DC voltage for operating the UV tube is followed by a period of time with a DC voltage which is not increased for operating the other UV tube.

7. The flame monitor according to claim 1, wherein the predetermined interval of time is one second.

8. The flame monitor according to claim 1, wherein the DC voltage is generated by a cascade circuit, in particular a Villard cascade circuit, with a charge pump.

9. The flame monitor according to claim 1, wherein the level of the DC voltage for operating the UV tubes can be preselected by the controller for a self-test of the UV tube.

10. The flame monitor according to claim 1, wherein the DC voltage for operating the UV tubes is increased for predeterminable periods of time in order to increase the sensitivity of a self-test of the respective UV tube.

11. The flame monitor according to claim 10, wherein a period of time with an increased DC voltage for operating the UV tube is followed by a period of time with a DC voltage which is not increased for operating the other UV tube.

12. The flame monitor according to claim 10, wherein periods of time with an increased DC voltage are periodic for a UV tube.

13. The flame monitor according to claim 1, wherein the UV tubes can be oriented to the flame root of the flame to be monitored via a rotatable latchable unit.

14. The flame monitor according to claim 13, wherein the UV tubes can be fastened in the unit via plug-in connections with secure locking.

15. The flame monitor according to one of claim 1, wherein the controller is in the form of an SMD.

16. The flame monitor according to claim 1, wherein the time for which the UV tubes are each switched on is in the region of several milliseconds, and the interval of time is approximately one second.

17. A method for detecting the presence of a flame with at least two UV tubes which each have an anode and cathode and are arranged to have substantially the same field of vision whereby ionization ignition pulses in each UV tube are detectable in a discharge area of each UV tube, comprising: switching the two UV tubes on and off in succession with a gap of a predefined time within a predetermined interval of time, whereby the UV tubes are switched on for a predeterminable period of time; counting and comparing the number of pulses obtained from each UV tube; and connecting the anode of the respective UV tube to earth potential between the operations of switching the UV tubes off and on in order to draw ionization in the discharge area.

18. The method according to claim 17, wherein the switching-on of the UV tubes, the counting and comparison of the pulses, and the connection of the anode to earth potential are carried out periodically and continuously.

19. The method according to claim 18, wherein the method is carried out without interruption.

20. The method according to claim 17, wherein the method is carried out without interruption.

* * * * *